United States Patent [19]

Skelly

[11] 4,199,144

[45] Apr. 22, 1980

[54] GOLF PUTTER

[76] Inventor: Michael A. Skelly, 1105 Laurel Dr., Lafayette, Calif. 94549

[21] Appl. No.: 947,999

[22] Filed: Oct. 2, 1978

[51] Int. Cl.[2] ..... A63B 53/00

[52] U.S. Cl. ..... 273/164; 273/167 J; 273/173

[58] Field of Search ..... 273/167 R, 167 C, 167 D, 273/167 F, 167 G, 167 J, 169–173, 163 R, 163 A, 164

[56] References Cited

U.S. PATENT DOCUMENTS

| | | | |
|---|---|---|---|
| D. 212,890 | 12/1968 | Rose | 273/167 D |
| D. 228,563 | 10/1973 | Brower | 273/164 |
| 3,815,910 | 6/1974 | Raines | 273/167 R X |
| 3,866,922 | 2/1975 | Marci et al. | 273/167 F X |
| 3,873,094 | 3/1975 | Sebo et al. | 273/163 R |
| 4,141,556 | 2/1979 | Paulin | 273/164 |

FOREIGN PATENT DOCUMENTS

| | | | |
|---|---|---|---|
| 632841 | 12/1961 | Canada | 273/163 R |

OTHER PUBLICATIONS

Golf Digest, vol. 13, #12, Dec. 1962, p. 91, "Glamour Gift for a Golfing Gal!".

*Primary Examiner*—Charles E. Phillips

[57] ABSTRACT

A golf club used to putt a golf ball during a game; the club including a shaft with a handle on one end, and a putter head on its other end, the putter head including a steel base having a clear, rock-hard, plastic face bonded to its front side, for striking against the golf ball, and the head having a groove on top, for lining up towards a hole.

1 Claim, 6 Drawing Figures

10
11
12
13
14
15
16
17
18
19
20
21
22
23
24
5

GOLF PUTTER

This invention relates generally to golf clubs. More specifically, it relates to a golf putter.

It is well known that many golf players very frequently miss getting a ball into a hole for two reasons: they do not apply quite enough force on the stroke for the ball to quite reach the hole, and also, their aim towards the hole is not correct enough.

Accordingly, it is a principal object of the present invention to provide a putter having a putter face, made of rock-hard plastic, that thus delivers a stronger force against a golf ball than a same-applied stroke of a conventional putter, so that the ball will travel approximately four to eight inches further.

Another object is to provide a putter having one or more grooves across its top surface, and which serve to line up towards a hole for improved directional aim, thus differing from conventional putters having grooves or lines behind the putter face, and thus give an illusion of lining up away from the hole, instead of towards it.

Other objects are to provide a golf putter which is simple in design, inexpensive to manufacture, rugged in construction, easy to use and efficient in operation.

These, and other objects, will be readily evident, upon a study of the following specification, and the accompanying drawings, wherein.

Figures 1, 2, 3, 4, 5, 6:
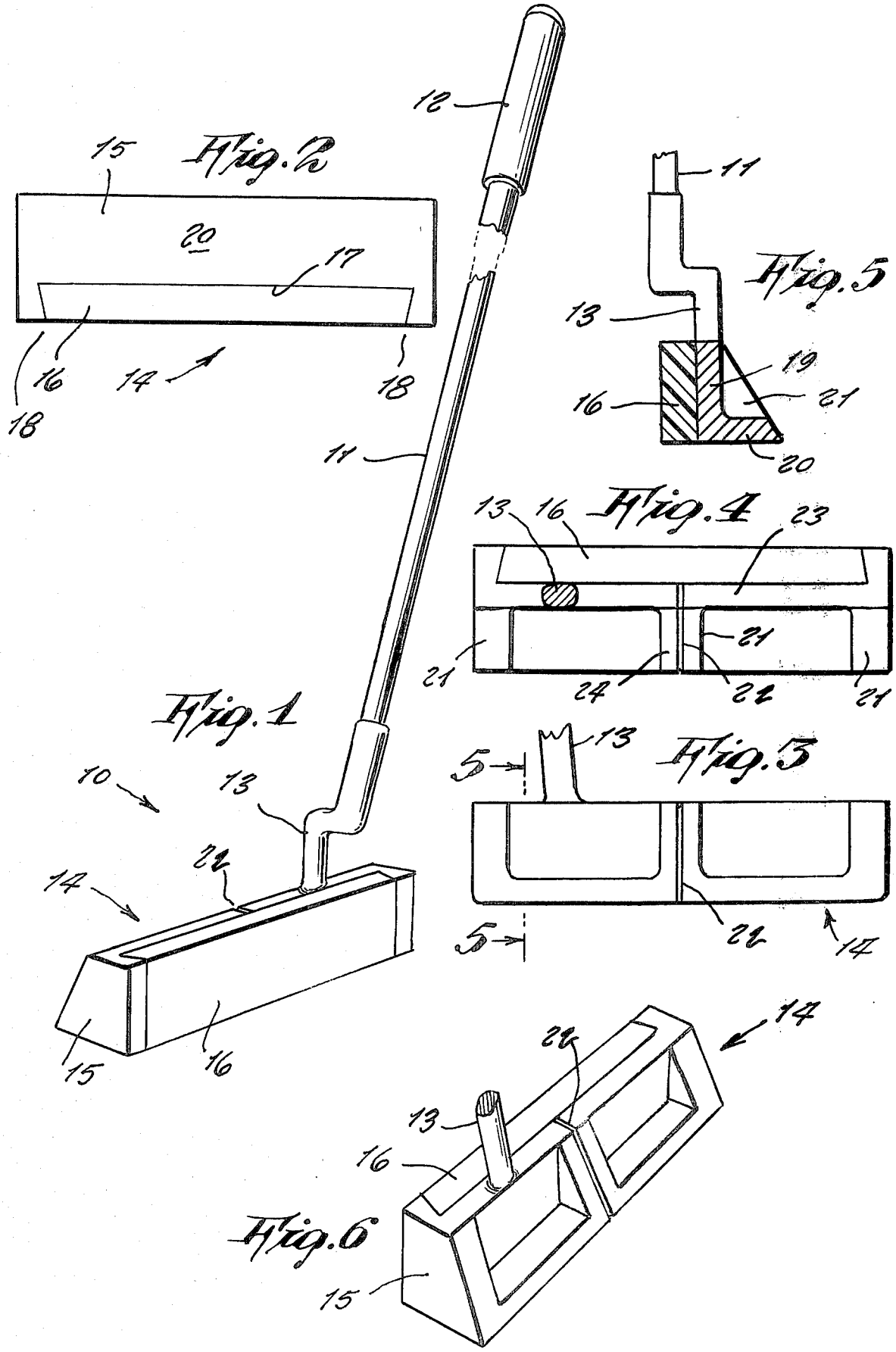
FIG. 1 is a front perspective view of the invention.
FIG. 2 is a bottom view thereof.
FIG. 3 is a rear view thereof.
FIG. 4 is a top view.
FIG. 5 is a cross-sectional view on line 5—5 of FIG. 3.
FIG. 6 is a rear perspective view of the club head.

Referring now to the drawing in greater detail, the reference numeral 10 represents a golf putter, according to the present invention, wherein there is a handle shaft 11, having a hand grip 12 at one end, while an offset tubing 13, at its other end, is attached to a putter head 14, that includes a steel base 15, having a face plate 16 imbedded within a front side thereof. The face plate is made of a transparent, rock-hard plastic material.

A practical size of the golf putter includes the club head base measuring four and one-fourth inches long, one and one-fourth inch thick and one inch high. A three-eighth inch deep recess 17, on the front side thereof, receives the face plate that is three-eighth inch thick, so that a front side of the face plate and base are flush at ends 18. The face plate is approximately three and three-fourths inches long, and is also one inch high, opposite ends of the face plate being angled, so as to set in the base.

The base includes generally a vertical wall 19, behind the face plate, and at right angles to a bottom wall 20. Three angular ribs 21 are integrally formed therebetween, on a rear side of the base.

In the present invention, a groove 22 extends across a top surface 23 of the base, extending from front to rear, midway between opposite side ends of the head. The groove is visible to a golf player looking downward at the head, so the groove, accordingly, extends on the upper surface 24 of the center of the ribs 21. The groove serves as a directional guide forwardly toward a hole. Alternately, three parallel grooves may be used instead of only one, as preferred by a manufacturer.

While various changes may be made in the detail construction, it is understood that such changes will be within the spirit and scope of the present invention, as is defined by the appended claims.

What I now claim is:

1. A golf putter, comprising, in combination, an elongated handle shaft, a hand grip on one end of said shaft, an offset tube at an opposite end of said shaft being affixed to a club head, said head comprising a steel base in the form of a block having a front vertical face and a rear face inclined with respect to said front face, the two faces being connected by a base surface and a top surface of a smaller dimension that said base, said rear face having two spaced apart triangular depressions in cross section rendering three equally spaced triangular ribs including a center one located midway between opposite ends of said club, said front face having a recess receiving a face plate made from transparent, rock-hard plastic material, said club head including a guide groove extending across said top surface from said face plate down the center one of said ribs to said base surface.

* * * * *